US010843376B2

(12) United States Patent
Walter

(10) Patent No.: US 10,843,376 B2
(45) Date of Patent: Nov. 24, 2020

(54) SEAMLESS STAMP DEVICE AND METHOD FOR IMPRESSING CONFIGURATIONS INTO DEFORMABLE MATERIALS

(71) Applicant: Greg C. Walter, Minooka, IL (US)

(72) Inventor: Greg C. Walter, Minooka, IL (US)

( * ) Notice: Subject to any disclaimer, the term of this patent is extended or adjusted under 35 U.S.C. 154(b) by 214 days.

(21) Appl. No.: 15/796,759

(22) Filed: Oct. 28, 2017

(65) Prior Publication Data

US 2018/0117792 A1 May 3, 2018

Related U.S. Application Data

(60) Provisional application No. 62/496,783, filed on Oct. 29, 2016.

(51) Int. Cl.
*B28B 7/00* (2006.01)
*E01C 19/43* (2006.01)

(52) U.S. Cl.
CPC ..... *B28B 7/0064* (2013.01); *E01C 19/43* (2013.01)

(58) Field of Classification Search
CPC ..... B28B 7/0064; E01C 19/43
USPC ..... 425/470
See application file for complete search history.

(56) References Cited

U.S. PATENT DOCUMENTS 4,135,840 A * 1/1979 Puccini ..... E01C 19/43 404/124
5,447,752 A * 9/1995 Cobb ..... B44F 9/04 264/31
6,951,435 B1 * 10/2005 Fennessy, Sr. ..... B28B 7/0064 249/188
9,463,658 B2 * 10/2016 Irwin ..... B41K 1/32
2004/0247390 A1 * 12/2004 Smith ..... B28B 11/0818 404/93
2004/0265058 A1 * 12/2004 Gregg ..... E01C 19/43 404/124
2004/0265059 A1 * 12/2004 Gregg ..... E01C 19/43 404/124
2005/0051041 A1 * 3/2005 Gregg ..... E01C 19/238 101/110

(Continued)

*Primary Examiner* — Robert C Dye
*Assistant Examiner* — Guy F Mongelli
(74) *Attorney, Agent, or Firm* — Donald Flaynik

(57) ABSTRACT

A seamless stamp device for impressing configuration into deformable materials includes a recess member having a substantially planar top wall and an undulating bottom wall with a plurality of ridges integrally joined to the bottom wall, the ridges defining a preselected pattern upon the bottom wall. The seamless stamp device further includes a protrusion member having a substantially planar top wall and an undulating bottom wall with a plurality of ridges integrally joined to the bottom wall, the ridges defining a preselected pattern upon the bottom wall. The recess and protrusion members are detachably engaged such that the undulating bottom walls and ridges of the engaged members provide a continuous, seamless design or pattern in the surface of a deformable material when the recess and protrusion members are forcibly inserted into the deformable material, then vertically elevated and vertically lowered and repositioned upon a different portion of the surface of the deformable material. The method repeating until the entire surface of the deformable material has been configured with the designs of the bottom walls and ridges of the recess and protrusion members.

19 Claims, 7 Drawing Sheets

(56) References Cited

U.S. PATENT DOCUMENTS

| | | | | |
|---|---|---|---|---|
| 2013/0170908 | A1* | 7/2013 | Lindley | E01C 19/28<br>404/117 |
| 2013/0177354 | A1* | 7/2013 | Farrell | E01C 19/43<br>404/75 |

* cited by examiner

SEAMLESS STAMP DEVICE AND METHOD FOR IMPRESSING CONFIGURATIONS INTO DEFORMABLE MATERIALS

This Utility Patent Application is based on Provisional Patent Application No. 62/496,783 filed on Oct. 29, 2016.

BACKGROUND OF THE INVENTION

1. Field of the Invention

The present invention relates to a device for impressing configurations into deformable material, and more particularly, to a device that uses a protrusion member having protrusion portions and a recess member having recess that are adjacently disposed upon a surface of a deformable material for impressing configurations into deformable material.

2. Background of the Prior Art

Devices used for impressing configurations into deformable materials, specifically concrete, are well known and commonly used. A typical device for impressing configurations into the concrete is manually operated such that a person urges a first stamp into the concrete to form a predetermined pattern. The person then selects a second stamp and disposes an edge portion of the second stamp adjacent to an edge portion of the first stamp while the first stamp is disposed in the concrete. The person then secures together predetermined edge portions of the first and second stamps to create a seamless pattern from the first to the second stamp that is impressed upon surface portions of concrete.

In particular, U.S. Pat. No. 9,463,658 (Irwin et al.), provides a method and apparatus for stamping concrete that places a first stamp having a first border portion with a portion of a first pattern being disposed in the first border portion; and places a second stamp having a second border portion with a portion of a second pattern being disposed in the second border portion such that the second border portion overlaps with the first boarder portion so as to create a seamless pattern continuing from the first stamp to the second stamp. The correct alignment between the portions of the first and second patterns being achieved via magnets disposed in the first and second border portions, or interlocking configurations for the first and second border portions.

The problem with prior art stamp devices used to form impressions in concrete is that the person using first and second stamps cannot see portions of the first stamp disposed upon the concrete as the person places second stamp upon the first stamp with the objective of aligning respective portions of patterns on the first and second stamps to seamlessly continue a pattern across the surface of the concrete. Using magnets or other alignment features incorporated into both stamps will not substitute for a visual aligning feature for the user as the aligning strength of the magnets attenuate or as a buildup of concrete around cooperating locking elements occurs for either or both the first and second stamps.

Further, when two prior art stamp devices are adjacently disposed to form an impression in the concrete, the adjacently disposed stamps squeeze portions of concrete between the adjacently disposed stamps, resulting in concrete being "squeezed" between adjacent peripheral edges of the stamps, the concrete then flowing above the surface of the concrete to ultimately deform the intended pattern to be impressed in the surface of the concrete. To prevent the flow of concrete between the adjacent stamps, there should be no edges formed between the stamps, and the stamps should be engagingly disposed via movement in only a vertical direction, resulting in an edge portion of a second stamp overlapping a cooperating edge portion of a first stamp being viane common number of edges formed by the adjacently disposed stamps should be A device is required for forming impressions in concrete that enables a user to visually align peripheral edge portions of adjacently disposed stamps to form patterns having seamless continuity between the patterns on both stamps, and that prevents concrete from being squeezed between adjacent disposed devices that deforms the pattern intended to be impressed into the surface of the concrete.

SUMMARY OF THE INVENTION

It is an object of the present invention to overcome many of the disadvantages associated with prior art concrete configuration devices. A principal object of the present invention is to provide a device having discrete protrusion and recess members that cooperate such that when the protrusion and recess members are adjacently disposed, a user of the device can maintain alignment and engagement between ridges on both members that form a pattern in concrete. A feature of the device is a protrusion portion of the protrusion member that congruently and vertically inserts into a cooperating recess in the recess member such that an end wall of the protrusion portion congruently engages and end wall of a ridge terminating at a lateral inner edge of the recess. An advantage of the device is that a user can visually and accurately align and engage unseen ridges on the bottom walls of the protrusion and recess members, when the bottom walls engage the surface of concrete, to impress predetermined patterns into the deformable concrete that require continuous and uninterrupted ridges that form continuous patterns via depressions in the concrete.

Another object of the present invention is to prevent concrete from being squeezed above and/or below adjacently disposed protrusion and recess members, thereby preventing displaced concrete from disfiguring the intend patters to be impressed in the surface of concrete. A feature of the device is tapered edge portions for the protrusion and recess members, the tapered edge portions having relatively thin edges about the respective member, and relatively thicker portions distally disposed from the thin edges about the respective member. Another feature of the device is that a tapered edge portion of a protrusion or recess member disposed upon concrete vertically receives a tapered edge portion of a cooperating recess or protrusion member such that the vertically engaged tapered edge portions substantially overlap to prevent edge portions of either of the vertically engaged tapered edge portions from engaging concrete. An advantage of the device is that the tapered edge portion of the recess member is able to insert under the tapered edge portion of the protrusion member, and the tapered edge portion of the protrusion member is able to insert under the tapered edge portion of the recess member when a bottom wall of either the recess member or the protrusion member is disposed upon the surface of concrete, thereby forming an overlap of respective tapered edge portions of the protrusion and recess members to prevent distortion of a pattern and/or to create a seamless pattern in the surface of the concrete. Another advantage of the device is that the end wall of the protrusion portion engaging with the end wall of the ridge of the recess portion, and the overlapping tapered edge portions of the recess and protrusion members, prevent concrete from being squeezed above and/or below adjacently disposed recess and protrusion members that would otherwise distort the intended pattern, thereby creating a seamless pattern in the surface of the concrete.

In brief, the invention provides a seamless stamp device for impressing configurations into deformable materials that includes:

a recess member having a bottom wall with a surface having a plurality of ridges integrally joined to the bottom wall, and a plurality of sides with at least two recesses disposed at a peripheral edge of each side, the ridges on the bottom wall surface being manually urged into a deformable material to form corresponding designs in the deformable material when the bottom wall of the recess member engages a surface of the deformable material; and a protrusion member having a bottom wall with a surface having a plurality of ridges integrally joined to the bottom wall, and having a plurality of sides with at least two protrusion portions extending from a peripheral edge portion of each side, the ridges of the bottom wall being manually urged into the deformable material to form corresponding designs in a deformable material when the bottom wall of the protrusion member engages a surface of the deformable material, the recess member and the protrusion member being detachably engaged to form a selected continuous seamless design in the deformable material; whereupon, one of the recess and protrusion members is elevated above the deformable material and repositioned upon a new surface of the deformable material, the repositioning of one of the recess and protrusion members being repeated until all of the surface of the deformable material has been configured with preselected designs.

The invention further provides a method for impressing configurations into deformable materials, the method including the steps of:

providing a recess member having a bottom wall with a surface having a plurality of ridges integrally joined to the bottom wall, and having a plurality of sides with at least two recess disposed at a peripheral edge of each side, the ridges of the bottom wall being manually urged into the deformable material to form corresponding designs in a deformable material when the bottom wall of the recess member engages a surface of the deformable material; and a protrusion member having a bottom wall with a surface having a plurality of ridges integrally joined to the bottom wall, and having a plurality of sides with at least two protrusion portions extending from a peripheral edge portion of each side, the ridges of the bottom wall being manually urged into the deformable material to form corresponding designs in a deformable material when the bottom wall of the protrusion member engages a surface of the deformable material, the recess member and the protrusion member being detachably engaged to form a selected continuous design in the deformable material without discontinuities and degradation; whereupon, one of the recess and protrusion members is elevated above the deformable material and repositioned upon a new surface of the deformable material, the repositioning one of the recess and protrusion members being repeated until all of the surface of the deformable material has been configured with preselected designs.

The invention also provides a seamless stamp for impressing configurations in concrete that includes a recess member having a bottom wall, and a plurality of sides with at least two recesses disposed at a peripheral edge of each side, the ridges of the bottom wall being manually urged into the concrete to form corresponding patterns in the concrete when the bottom wall of the recess member engages a surface of the concrete; and a protrusion member having a bottom wall with a plurality of ridges integrally joined to said bottom wall, and having a plurality of sides with at least two protrusion portions extending from a peripheral edge portion of each side, the ridges of the bottom wall being manually urged into the concrete to form corresponding patterns in the concrete when the bottom wall of the protrusion member engages a surface of the concrete. The protrusion portions of the protrusion member are rectangular configured with a lateral dimension substantially equal to the lateral dimension of the recesses in the recess member. The protrusion portions have a longitudinal dimension substantially about one-half the longitudinal dimension of the recesses, resulting in an overlap of the tapered edge portion of the protrusion member upon the tapered edge portion of the recess member when the protrusion portions are snugly inserted into the recesses of the recess member. The recess member and the protrusion member are detachable engaged to form a selected seamless pattern in the concrete; whereupon, one of the recess and protrusion members is vertically elevated above the concrete and vertically lowered and repositioned upon a new surface of the concrete such that the recess member and the protrusion member are detachably engaged to form another selected seamless pattern in the concrete. The repositioning of the one of the recess and protrusion members is repeated until all of the surface of the concrete has been configured with preselected seamless patterns.

BRIEF DESCRIPTION OF THE DRAWINGS

The foregoing invention and its advantages may be readily appreciated from the following detailed description of the preferred embodiment, when read in conjunction with the accompanying drawings in which.

DESCRIPTION OF THE PREFERRED EMBODIMENT

Figure 1:
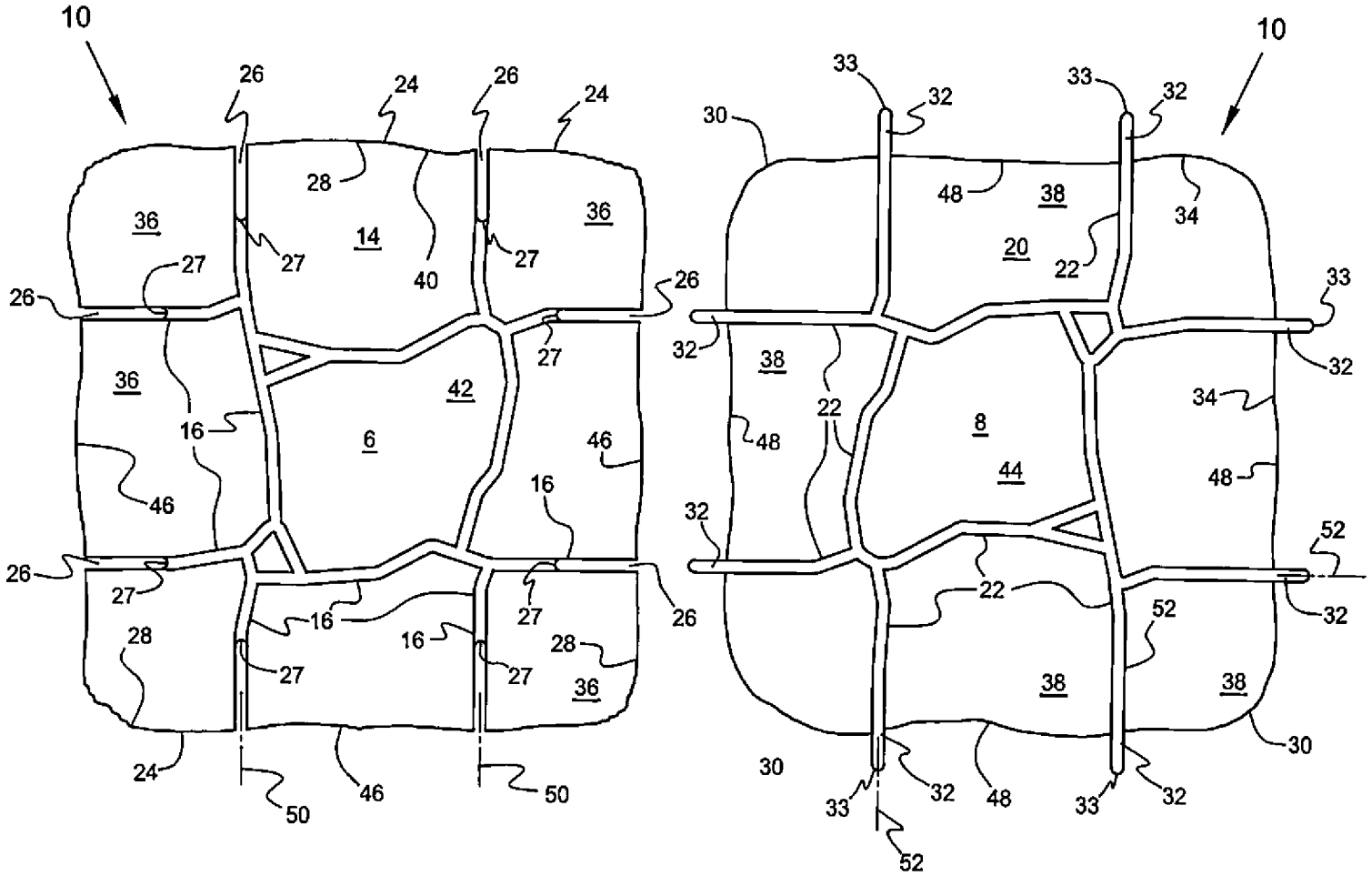
FIG. 1 is a bottom view of a seamless stamp device having a recess member and a protrusion member disposed such that recesses in the recess member are aligned with and separated from protrusions of a protrusion member to promote detachable engagement of the recess and protrusion members for impressing configuration into deformable materials in accordance with the present invention.

Referring now to the drawings, a seamless stamp device for impressing configurations into deformable materials that ultimately harden into non-deformable configurations in accordance with the present invention is denoted as numeral 10. The seamless stamp device 10 is fabricated from a myriad of materials including but not limited to polyurethane, relatively hard rubber, and similar relatively rigid, lightweight materials. The seamless stamp device 10 includes a recess member 6 having a substantially planar top wall 12 and an undulating bottom wall 14 with a plurality of ridges 16 integrally joined to the bottom wall 14, the ridges 16 defining a preselected pattern upon the bottom wall 14. The seamless stamp device further includes a protrusion member 8 having a substantially planar top wall 18 and an undulating bottom wall 20 with a plurality of ridges 22 integrally joined to the bottom wall 20, the ridges 22 defining a preselected pattern upon the bottom wall 20.

Each ridge 16 extending from the bottom wall 14 of the recess member 6 continues upon the bottom wall 14 until intersecting with another ridge 16 or until terminating proximate to a non-linear and irregular configured peripheral edge 24 of the recess member 6. The respective ridge 16 terminating proximate to the peripheral edge 24 is lineally aligned with a substantially rectangular configured recess 26 having a longitudinal dimension of about three inches and a lateral dimension of about one-half inch, and longitudinally extending from an end wall 27 of the respective ridge 16 and perpendicularly extending to a corresponding side 28 of the recess member 6. The preferred number of ridges 16 terminating proximate to each side 28 of the recess member 6 is two, although more recess 26 can be added to each side 28 as required by the user of the device 10.

Each ridge 22 extending from the bottom wall 20 of the protrusion member 8 continues upon the bottom wall 20 until intersecting with another ridge 22 or until extending past a non-linear irregular configured peripheral edge 30 of the protrusion member 8 to form a substantially rectangular configured protrusion portion 32 having the same configuration as the ridges 22. The protrusion portions 32 include substantially the same lateral dimensions as the recesses 26 in the recess member 6, but the longitudinal dimension of the protrusion portions 32 is about one and one-half inches or about one-half the longitudinal dimension of the recesses 26, thereby allowing substantially about a one and one-half inch overlap of corresponding tapered edge portions 36 and 38 of respective recess and protrusion members 6 and 8. The overlap of the tapered edge portions 36 and 38 prevents a ridge of deformable material from forming when the recess and protrusion members 6 and 8 are adjacently disposed to form the device 10 for configuring the deformable material. The protrusion portions 32 extend substantially perpendicularly from the peripheral edge 30 of the protrusion member 8.

The preferred number of ridges 22 extending past the peripheral edge 30 for each side 34 of the protrusion portion 32 is two, although more protrusion portions 32 can be added when the number of corresponding recesses 26 in the recess member 6 is greater than two, but irrespective of the number recesses 26 in each side 28 of the recess member 6, the number of protrusion portions 32 extending from a cooperating side 34 of the protrusion member 8 must equal the number of recesses 26 in the side 28 of the recess member 6 that engages the cooperating side 34 of the protrusion member 8. Although the recess member 6 has been described with only recesses 26 and the protrusion member 8 described with only protrusion portions 32, the recess member 6 can have one side 28 with two recesses 26 and an adjacent or opposite side 28 with two protrusion portions 32 extending from the respective side or sides. Correspondingly, the protrusion member 8 can have one side 34 with only protrusion portions 32 and a second side 40 with only recesses 26.

Irrespective of the number of recesses 26 and cooperating protrusion portions 32 per side 28 and 34 of the respective recess and protrusion member 6 and 8, the configuration and dimensions for each recess 26 must be constant, and the configuration and dimensions for each protrusion portion 32 must be constant. Further, the configuration and dimensions for each protrusion portion 32 must promote the snug, substantially congruent insertion of each protrusion portion 32 on any one of four sides 34 of the protrusion member 8 into a corresponding recess 26 in any one of four sides 28 of the recess member 6, such that a tapered edge portion 36 of the member 6 which extends about the periphery of the recess member 6 to form about a three inch border; and a tapered edge portion 38 of the protrusion member 8 which also extends about the periphery of the member 8 to form about a three inch border, overlap when each recess 26 in a respective side 28 of the recess member 6 snugly receives a protrusion portion 32 extending from a respective side 34 of the protrusion member 8. The overlapping of the tapered edge portions 36 and 38 prevents the forming of a relatively small ridge (not depicted) in a deformable material that would otherwise be formed between engaging peripheral edges 24 and 30 of engaging sides 28 and 34 of adjacently disposed recess and protrusion members 6 and 8 that are positioned such that the edge portions 24 and 30 "butt" together. To achieve a seamless pattern continuing across the surface of concrete or other deformable material, cooperating tapered edge portions 36 and 38 of recess and protrusion members 6 and 8 are vertically lowered upon and ultimately overlap each other as a pattern is urged into the surface of the concrete, irrespective of the protrusion member 8 being lower upon the recess member 6, or the recess member 6 being lowered upon the protrusion member 8.

Figure 2:
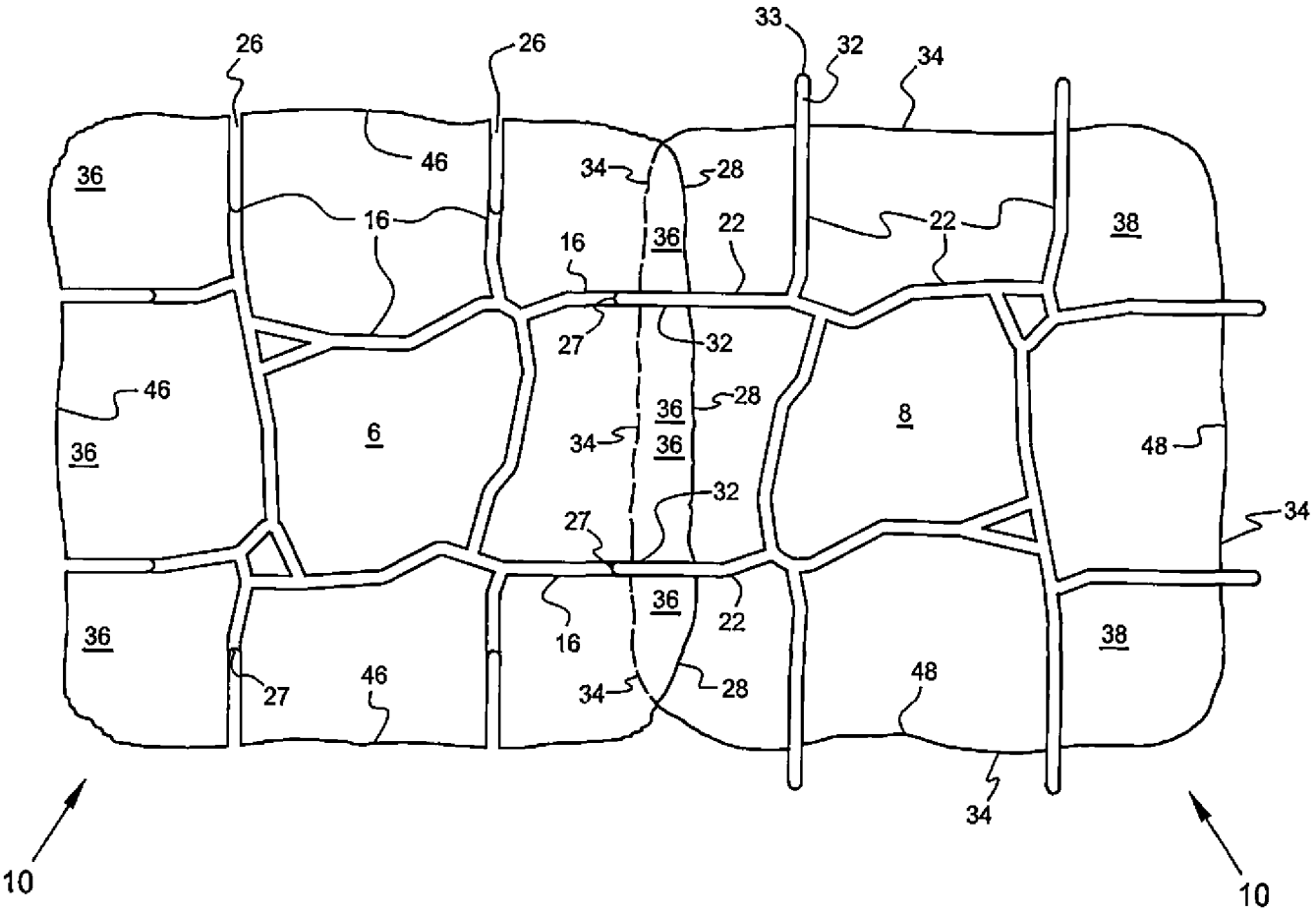
FIG. 2 is the bottom view of FIG. 1 but with the recess member detachably engaged with the protrusion member for impressing a configuration into a deformable material in accordance with the present invention.
Figure 3:
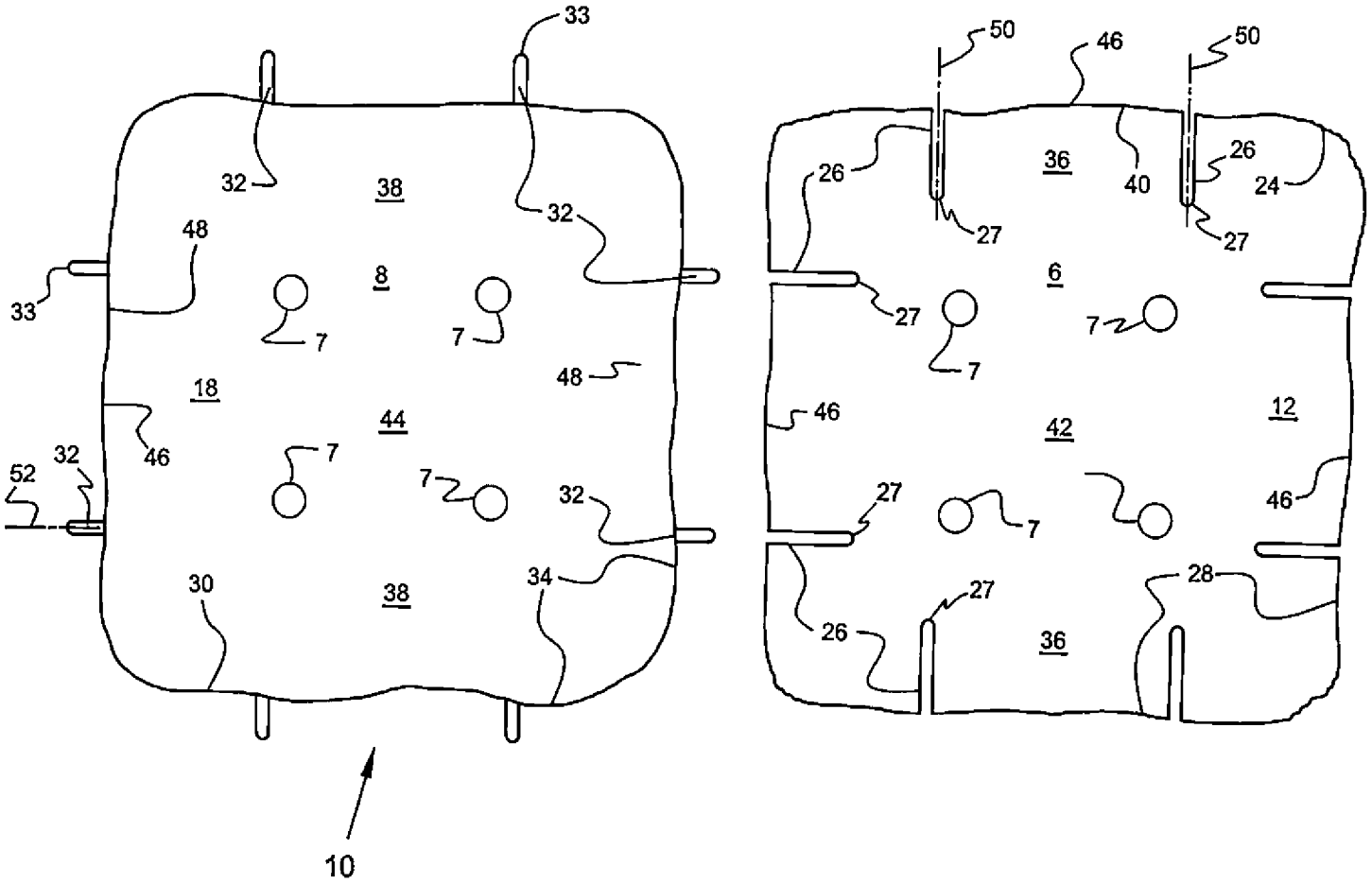
FIG. 3 is a top view of the seamless stamp device of FIG. 1.
Figure 4:
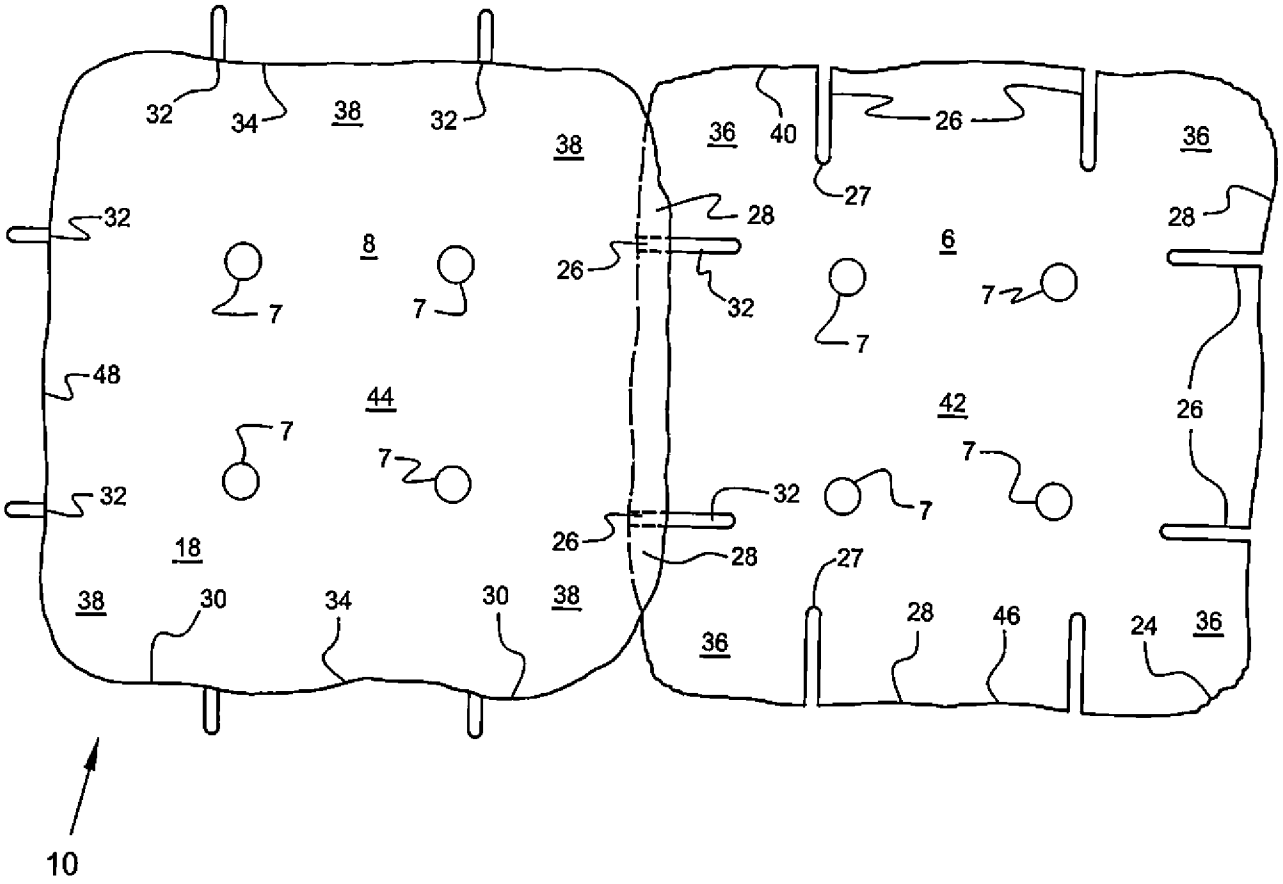
FIG. 4 is a top view of the seamless stamp device of FIG. 2.

The primary function of the recesses 26 and protrusion portions 32 is to act as a visual aid or "sight" or a person disposing the recess and protrusion members 6 and 8 upon a deformable material when only the top walls 12 and 18 of the respective recess and protrusion member 6 and 8 is visible to the person. More specifically, the bottom walls 14 and 20 of the respective recess and protrusion member 6 and 8 are unseen (see FIGS. 3 and 4) by a person when urging the ridges 16 and 22 and undulating surfaces of the bottom walls 14 and 20 into the deformable material to form a pattern or artistic figure into the deformable material. The person using the recess and protrusion members 6 and 8 to construct a pattern in the deformable material will usually start with the bottom wall 14 of the recess member 6 disposed upon a preselected starting corner surface or side surface of a deformable material such as concrete that over time will set-up or harden. Next, the user will select one of four possible sides 34 of the protrusion member 8 that will provide a first selected pattern upon the deformable material (see FIGS. 1 and 2).

Figure 5:
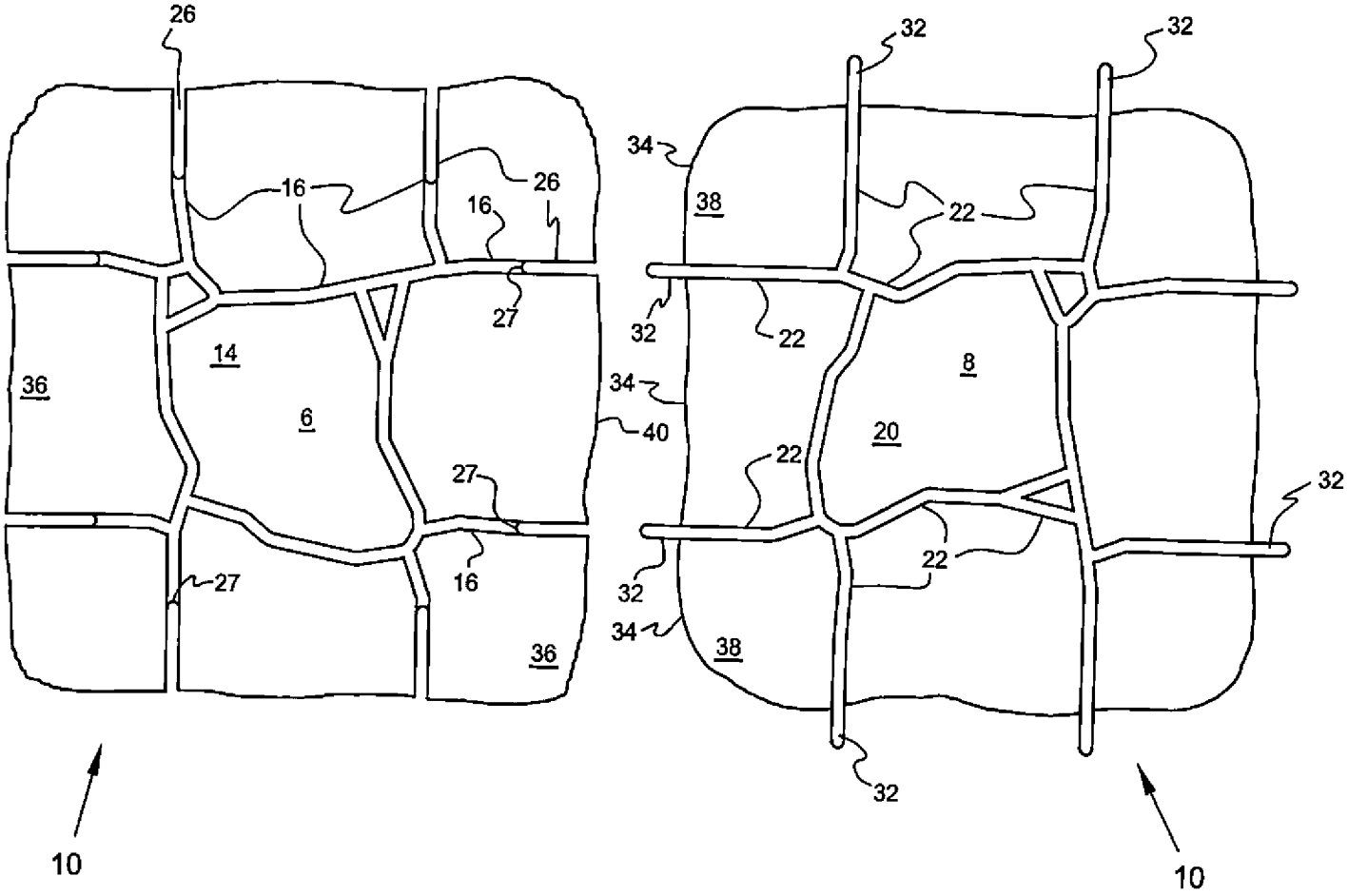
FIG. 5 is a bottom view of the seamless stamp of FIG. 1 but with the a second side of the recess member rotated ninety degrees such that the second side engages the protrusion member to form a new configuration when the recess and protrusion members are impressed into deformable materials in accordance with the present invention.
Figure 6:
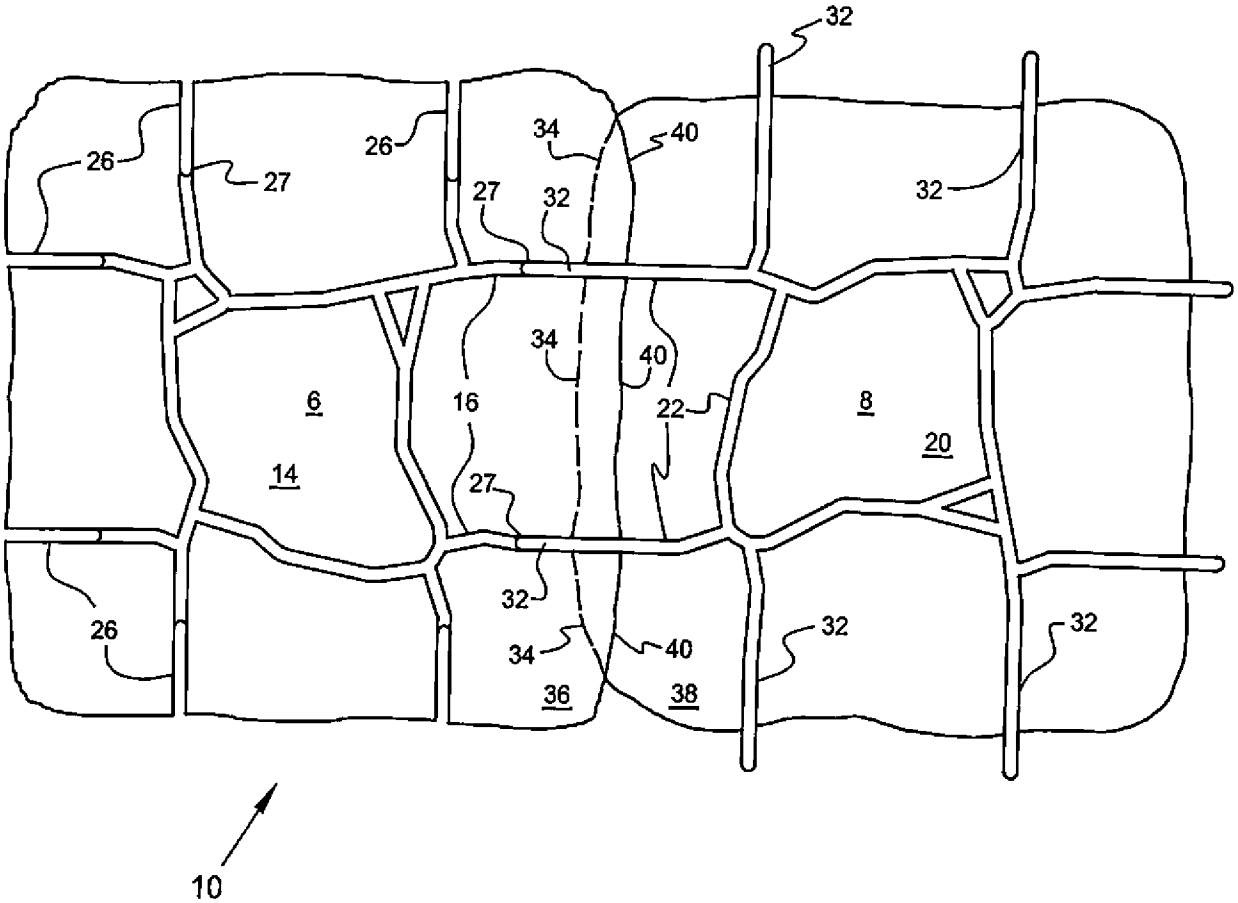
FIG. 6 is a bottom view of the seamless stamp device of FIG. 2 but with the recess member rotated ninety degrees as depicted in FIG. 5.
Figure 7:
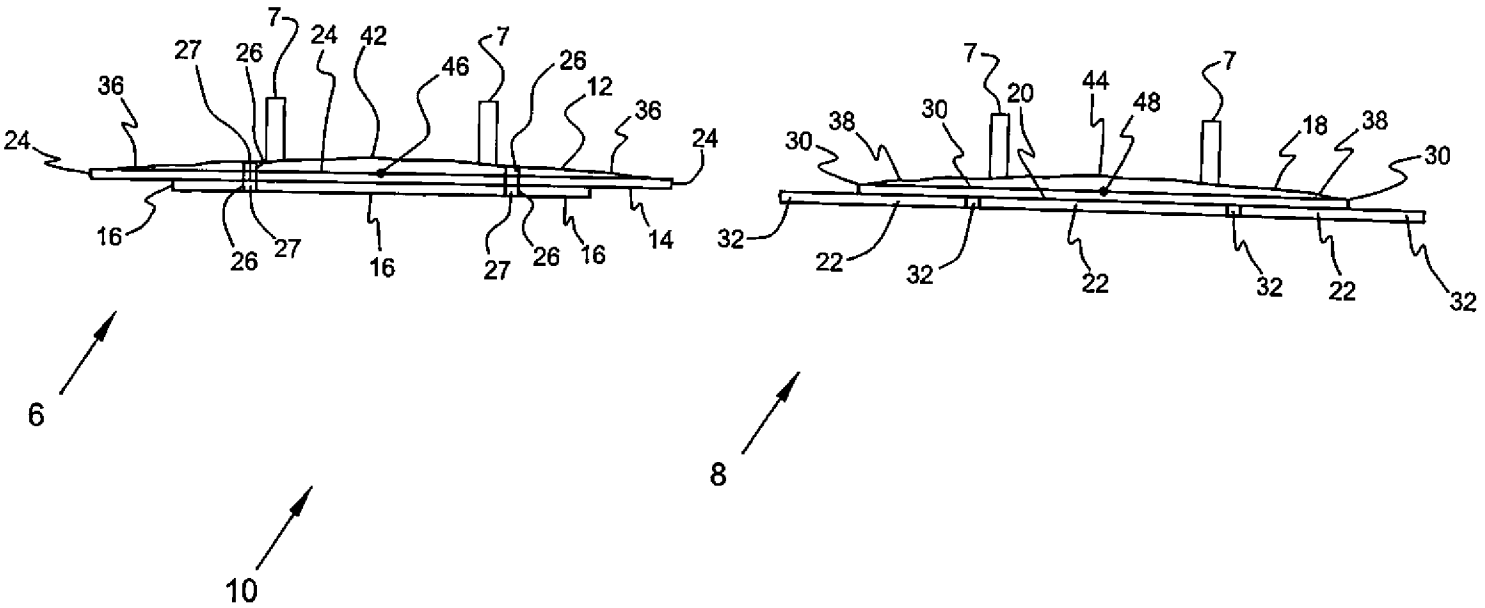
FIG. 7 is a side view of the recess and protrusion members of FIG. 1.

Irrespective of the side 34 of the protrusion member 8 selected, the protrusion portions 32 of the side 34 selected will engage and align with a corresponding end wall 27 of the ridges 16 terminating at a lateral end of the adjacent recess 26 of the recess member 6, when the protrusion portions 32 are vertically inserted into cooperating recesses 26, resulting in a continuous pattern without aberrations in the configuration impressed into the deformable material by two separate recess and protrusion members 6 and 8. Without the recess and protrusion portions 26 and 32 to act as an alignment guide for the user, ridge and undulating patterns configured into the deformable material by the recess and protrusion members 6 and 8 would have "interruptions" or discontinuity imperfections in the patterns formed into the deformable material after the recess and protrusion members 6 and 8 are removed from the deformable material. However, rather than removing both members 6 and 8, the user normally will remove the first positioned member, whereupon, the same recess member 6 will be rotated, then repositioned such that a second side 40 of the recess member 6 is disposed such that the second side 40 engages a different side 34 of the protrusion member 8, resulting in a variation of the pattern impressed upon the deformable material by using only one recess member 6 and one protrusion member 8 and rotating one or both of the members 6 and 8 to constantly vary the pattern upon the deformable material as each member 6 and 8 is lifted from and repositioned upon the deformable material. Referring to FIG. 1, the recess member 6 is disposed adjacent to and separated from the protrusion member 8. Referring to FIG. 5, the recess member 6 has been rotated such that the second side 40 of the recess member 6 is disposed adjacent to and separated from the protrusion member 8. Referring to FIG. 6, the second side 40 of the recess member 6 engages the protrusion member 8 such that the tapered edge portion 38 of the protrusion member 8 overlaps the tapered edge portion 36 of the recess member 6.

A second function of the recesses 26 and protrusion portions 32 is to secure together and maintain alignment between the recess and protrusion members 6 and 8 upon a deformable material as the undulating bottom walls 14 and 20, and the ridges 16 and 22 integrally joined to the respective bottom walls 14 and 20, are forcibly and concurrently urged to penetrate the surface of a relatively firm deformable material and ultimately insert into the deformable material to form a configuration consistent with the undulating bottom wall 14 and 20, and ridge 16 and 22 patterns of the recess and protrusion members 6 and 8. The preferred number of recess 26 and protrusion portion 32 combinations is two per side, although a fewer or greater number per side can be provided. However, less recess 26 and protrusion portion 32 combinations per side reduces the securing and alignment maintaining features of the detachably joined recess and protrusion members 6 and 8; and more recess and protrusion portion combinations increases the time and costs for the user to align and disposed the members 6 and 8 upon the surface of the deformable material.

The top and bottom walls 12 and 14 of the recess member 6 and the top and bottom walls 18 and 20 of the protrusion member 8, in a preferred embodiment, are separated a distance of substantially about one quarter to three-eighths of an inch that defines "thicker" mid-portions 42 and 44 for the recess and protrusion members 6 and 8, respectively. The mid-portions 42 and 44 are slightly tapered from the center of the mid-portions 42 and 44 until integrally joining respective tapered edge portions 36 and 38 of the recess and protrusion members 6 and 8, resulting in a thickness of substantially about one-eighth of an inch. The tapered edge portions 36 and 38 ultimately taper to form the peripheral edges 24 and 30 of the recess and protrusion member 6 and 8, the peripheral edges 24 and 30 being substantially about one thirty-second of an inch, resulting in a small gap between the bottom wall 14 of the recess member 6 and the peripheral edge 24 of the bottom wall 20 of the protrusion member 8 and correspondingly prevents deformable material forming a ridge in the small gap as the recess and protrusion members 6 and 8 are forcibly inserted into the deformable material.

Alternatively, the top and bottom walls 12 and 14 of the recess member 6, and top and bottom walls 18 and 20 of the protrusion member 8 can be separated greater distances that provide a "thicker" more rigid members 6 and 8 and consequently a more rigid device 10 when required to forcibly insert the ridges 16 and 22 into a relatively dense deformable material or into a deformable material that has substantially hardened but is still deformable. The distances separating the top and bottom walls 12 and 14, and 18 and 20 of the preferred embodiment can be reduced, but the resulting device 10 would be to "flexible" when the surface area of the device 10 approaches substantially about sixteen square feet, irrespective of the configuration of the device 10 being square, rectangular, triangular of otherwise. When the device 10 is to thin and flexible, the user has difficulty disposing the device 10 on a predetermined surface portion of the deformable material, resulting in misalignment between the device 10 and the selected surface portion.

To enable a user of the device 10 to forcibly and vertically insert the recess and protrusion members 6 and 8 into a deformable material such as concrete, then forcibly and vertically elevate the members 6 and 8 from the concrete, a plurality of cylindrical configured hand grips 7 are integrally joined to the top walls 12 and 18 of the members 6 and 8. The number of hand grips 7 correspond to the number of sides of the members 6 and 8, thereby enabling a user to consistently and vertically urge selected portions of the respective member 6 and 8 into and from the concrete to maintain a seamless pattern across the entire surface of the concrete.

The ridges 16 and 22 are integrally joined to respective bottom walls 14 and 20, and extend a predetermined distance (generally about one-half inch) from the bottom walls 14 and 20 to form predetermined designs or patterns 18 in the deformable material, when the device 10 is disposed upon and forcibly urged (by an individual or machine) into the deformable material, thereby forcing the ridges 16 and 22 into the deformable material until the bottom walls 14 and 20 engage and penetrate the deformable material; whereupon, after removing the device 10 from the deformable material, a mirror image of the recess and protrusion members 6 and 8 designs 18 is formed into the deformable material and becomes permanent after the deformable material "sets-up" or hardens.

The seamless stamp device 10 can be used to configure horizontal surfaces (typically concrete driveways or patios) or can be used to configure vertical surfaces such as plaster on walls. Irrespective of the surface or deformable material, one seamless stamp device 10 formed from one recess 6 and one protrusion 8 member can be used to design the entire surface of the deformable material. Further, the device 10 can include recess and protrusion members 6 and 8 that are rectangular configured with relatively long longitudinal dimensions (ten feet for example) and with relatively short lateral dimensions (one foot for example), or with one relatively long recess member 6 and multiple protrusion members 8 that total the same longitudinal dimension as the relatively long recess member 6. The only limitation to the dimensions and configurations for the recess and protrusion members 6 and 8 for configuring a deformable material is the imagination of the fabricator of the device 10.

To enable the recess and protrusion members 6 and 8 to be cooperatively joined together irrespective of the configurations of the peripheral edges 24 and 30 of the relative sides 28 and 34 of the members 6 and 8, the positioning of each recess 26 and each protrusion portion 32 on each side 28 and 34 must be determined by first identifying the midpoints 46 and 48 for respective sides 28 and 34 of the members 6 and 8, then disposing each recess 26 and each protrusion portion 32 the same distance measured from the respective midpoint 46 and 48 to a centerline 50 for each recess 26, and to a centerline 52 for each protrusion portion 32.

The constant distance of separation between the recesses 26 and the protrusion portions 32 on respective sides 28 and 34 of the members 6 and 8, allows any side 28 of the recess member 6 to be detachably joined to any side 34 of the protrusion member 8 to form a unique design for each one of a plurality of surfaces for multiple deformable material locations by using only one recess member 6 and one protrusion member 8 to form the device 10. As long as recesses 26 and protrusion portions 32 can be axially aligned when joining a recess member 6 to a protrusion member 8, the devices 10 can have a myriad of configurations and dimensions to form any design into a deformable material. Although only one of each of the recess 6 and protrusion members 8 have been detailed for the device 10, the scope of the present invention can be expanded to include multiple recess members 6 to be used with one protrusion member 8, or one recess member 6 with multiple protrusion members 8, or multiple recess members 6 and multiple protrusion members 8. Further, each recess member 6 and each protrusion member 8 can have a unique design configuration formed upon a respective bottom wall 14 and 20; and each recess member 6 and each protrusion member 8 can have a unique configuration (square, rectangular, triangular, etc.) with a unique set of dimensions.

In operation, a recess member 6 is disposed upon a surface of a deformable material followed by a protrusion member 8 being disposed on the deformable material such that protrusion portions 32 extending from a selected side 34 of the protrusion member 8 are vertically inserted into cooperating longitudinally longer recesses 26 in a tapered edge portion 36 of the recess member 6. The insertion of the protrusion portions 32 into the longitudinally longer recesses 26 results in an end wall 33 of the protrusion portion 32 engaging an end wall 27 of a cooperating ridge 16 secured to the bottom wall 14 of the recess member 6. Further, the engaged end walls 33 and 27 result in the overlap of the tapered edge portion 38 of the protrusion member 8 upon the tapered edge portion 36 of the recess member 6 to prevent deformable material from being "squeezed" between peripheral edges 24 and 30 of respective recess and protrusion members 6 and 8, thereby preventing ridges of deformable material from forming that would degrade the design of the configuration impressed into the deformable material by the bottom wall 14 and ridges 16 of the recess member 6, and the bottom wall 20 and ridges 22 of the protrusion member 8.

The joined recess and protrusion members 6 and 8 disposed upon the deformable material are forcibly urged into the deformable material until respective bottom walls 14 and 20 engage the surface of the deformable material. The protrusion portions 32 of the protrusion member 8 are separated from corresponding recesses 26, whereupon, either the recess member 6 or the protrusion member 8 is elevated from the surface of the deformable material, then replaced upon a new smooth surface of the deformable material such that recesses 26 and protrusion portions 32 from different sides 28 of the recess member 6 and/or the protrusion member 8 are again detachably engaged to form the same or different configuration into the surface of the deformable material. The method is repeated until the joined recess and protrusion members 6 and 8 that form the device 10 have systematically and sequentially been impressed into and removed from the deformable material, until a predetermined design has been formed upon and impressed into the entire surface of the deformable material without any seams or ridges formed upon the deformable material that would degrade the design via peripheral edges 24 and 30 of the recess and protrusion members 6 and 8, and without any seams or ridges formed from the insertion of the protrusion portions 32 of the protrusion member 8 into the recesses 26 of the recess member 6.

The invention claimed is:

1. A stamp device having adjacently disposed members with overlapping portions for impressing seamless configurations into deformable materials comprising:

a recess member having a bottom wall with ridges that form a design that is ultimately pressed in a deformable material, and having a plurality of sides with at least two recesses disposed at a peripheral edge of each side of said recess member, each of said plurality of sides of said recess member having a tapered edge portion, said ridges continuously extending upon said bottom wall wherein said ridges ultimately form an end wall aligned with a lateral inner end portion of each recess disposed at a peripheral edge of each side of said recess member, said ridges of said bottom wall being manually disposed upon a predetermined surface portion of a deformable material wherein said end walls of said ridges are adjacent to the predetermined surface portion of the deformable material, said ridges ultimately forming corresponding designs in the predetermined surface portion of the deformable material when said bottom wall of said recess member engages the predetermined surface portion of the deformable material; and a protrusion member having a bottom wall with ridges that form a design that is ultimately pressed into the deformable material, and having a plurality of sides with at least two protrusion portions formed via ridges extending past a peripheral edge of said protrusion member, said formed protrusion portions including an end wall that ultimately engages said recess member end walls, each of said plurality of sides of said protrusion member having a tapered edge portion dimensioned and configured to cooperate with a cooperating tapered edge portion of said recess member, said protrusion portions having longitudinal dimensions shorter than longitudinal dimensions of corresponding recesses in said recess member, thereby enabling a tapered edge portion of said protrusion member to vertically engage and overlap a tapered edge portion of said recess member, said overlap preventing displaced deformable material seams when said protrusion portions are inserted into said recesses of said recess member when said protrusion portion end walls engage said recess member end walls, said protrusion portions having configurations and dimensions that promote congruent insertions into corresponding recesses in said recess member, whereby, said ridge formed protrusion portions of said protrusion member and said end walls of said recess member ridges are exposed to a user, thereby providing a visual aid for the user to align and engage ridges extending from said protrusion member to said recess member when said recess and protrusion member ridges secured to bottom walls of said members are unseen during alignment of said members for insertion of said ridges into the deformable material, thereby forming continuous ridges extending from said recess member to said protrusion member, said ridges ultimately forming corresponding seamless designs in the predetermined surface portion of the deformable material when said bottom walls of said recess and protrusion members engage the predetermined surface portion of the deformable material.

2. The device of claim 1 wherein said tapered edge portions of said recess member includes a dimension separating top and bottom walls of a peripheral edge of said tapered edge portions that provides a seamless pattern in the deformable material.

3. The device of claim 1 wherein said tapered edge portions of said protrusion member includes a dimension separating top and bottom walls of a peripheral edge of said tapered edge portions that provides a seamless pattern in the deformable material.

4. The device of claim 1 wherein said top wall and said bottom wall of said recess member are separated a distance at a mid-portion of said recess member that provides a mid-portion thicker than said tapered edge portion of said recess member.

5. The device of claim 1 wherein said top wall and said bottom wall of said protrusion member are separated a distance at a mid-portion of said protrusion member that provides a mid-portion thicker than said tapered edge portion of said protrusion member.

6. The device of claim 4 wherein said tapered edge portion of said recess member tapers to form a peripheral edge that impresses seamless configurations into deformable materials, irrespective of the configuration of said peripheral edge of said recess member, when said tapered edge portion of said protrusion member is disposed upon said tapered edge portion of said recess member.

7. The device of claim 6 wherein said peripheral edge of said recess member impresses seamless configurations into deformable materials irrespective of a side of said recess member that a peripheral edge portion of said protrusion member is disposed upon.

8. The device of claim 6 wherein said tapered edge portion of said protrusion member tapers to form a peripheral edge that impresses seamless configurations into deformable materials, irrespective of the configuration of said peripheral edge of said protrusion member, when said tapered edge portion of said recess member is disposed upon a tapered edge portion of said protrusion member.

9. The device of claim 8 wherein said peripheral edge of said protrusion member impresses seamless configurations into deformable materials irrespective of a side of said protrusion member that a peripheral edge portion of said recess member is disposed upon.

10. The device of claim 9 wherein said protrusion portions of said protrusion member are rectangular configured with a lateral dimension that promotes a congruent insertion of said protrusion portions into cooperating recesses in said recess member, said protrusion portions having a longitudinal dimension one-half the longitudinal dimension of said recesses, resulting in an overlap of said tapered edge portion of said protrusion member upon said tapered edge portion of said recess member of one-half the longitudinal dimension of a recess in said recess member when said protrusion portions are congruently inserted into said recesses of said recess member, thereby maintaining engagement between end walls of said protrusion portions of said protrusion member and cooperating end walls of ridges of a corresponding side of said recess member, resulting in continuity of said ridges of said recess member and said ridges of said protrusion member when said ridges are inserted into the deformable material with sufficient force to form a design in the deformable material that ultimately covers the entire surface of the deformable material without deformation of the design configuration.

11. The device of claim 8 wherein protrusion portions of each side of said protrusion member are insertable into corresponding recesses in each side of said recess member via said protrusion portions and said recesses being disposed equal distances from a midpoint of a respective side of recess and/or protrusion members, said equal distance separating each recess and protrusion portion from a respective midpoint of a respective side is measured from a midpoint of said respective side to a centerline of a respective recess and/or protrusion portion.

12. The device of claim 1 wherein there are two of said recesses in each side of said recess member, and there are two of said protrusion portions on each side of said protrusion member, the dimensions separating longitudinal centerlines of recesses on each side of a recess member are equal the dimensions separating longitudinal centerlines of protrusion portions on each side of a protrusion member, thereby allowing a relatively snug insertion of said protrusion portion into cooperating recesses.

13. The device of claim 1 wherein said recess member and said protrusion member can have one side with only recesses and a second side with only protrusion members extending from said second side, said combination of recesses and protrusion portions on one member reducing the number of distinct member configurations required for impressing seamless configurations into deformable materials from recess and protrusion members to one combination member.

14. The device of claim 1 wherein said protrusion member and said recess member can have one side with only protrusion portions extending from said one side, and an adjacent side with only recesses.

15. The device of claim 1 wherein said sides of said recess member includes one recess and said sides of said protrusion member includes one protrusion portion.

16. The device of claim 15 wherein said recess member is disposed upon a surface of a deformable material, wherein an end wall of a ridge at said one recess in a side of said recess member provides a visual aid for a user to dispose said protrusion member upon the deformable material wherein an end wall of a ridge of said one protrusion portion of a side of said protrusion member engages said end wall of said ridge at said one recess of said recess member.

17. The device of claim 16 wherein said engaged end walls of said one protrusion portion and said one recess result in the overlap of a tapered edge portion of said protrusion member upon a tapered edge portion of said recess member, thereby forming a continuous ridge extending from said recess member to said protrusion member, said ridges of said protrusion and recess members ultimately forming corresponding designs in the deformable material when said bottom walls of said protrusion and recess members engage the deformable material, said continuous ridge and said overlapping tapered edge portion of said protrusion and recess members forming a continuous seamless configuration when pressed into corresponding surface portions of the deformable material.

18. A stamp device having members with overlapping portions for impressing seamless configurations in deformable materials comprising:

a recess member having a bottom wall with ridges that form a design that is ultimately pressed in a deformable material, and having a plurality of sides with at least one recess disposed at a peripheral edge of each side of said recess member, each of said plurality of sides of said recess member having a tapered edge portion, said ridges continuously extending upon said bottom wall wherein said ridges ultimately form an end wall aligned with a lateral inner end portion of each recess disposed at a peripheral edge of each side of said recess member, said ridges of said bottom wall being manually disposed upon a predetermined surface portion of a deformable material wherein said end walls of said ridges are adjacent to the predetermined first surface portion of the deformable material, said ridges ultimately forming corresponding patterns in the predetermined first surface portion of the deformable material when said bottom wall of said recess member engages the predetermined first surface portion of the deformable material; and a protrusion member having a bottom wall with ridges that form a design that is ultimately pressed into the deformable material, and having a plurality of sides with at least one protrusion portion formed via ridges extending past a peripheral edge of said protrusion member, said formed protrusion portions including an end wall that ultimately engages said recess member end walls, each of said plurality of sides of said protrusion member having a tapered edge portion dimensioned and configured to cooperate with said tapered edge portions of said recess member, said protrusion portion for each side having a longitudinal dimension shorter than the longitudinal dimension of the cooperating recess in said recess member, thereby enabling a tapered edge portion of said protrusion member to vertically engage and overlap a tapered edge portion of said recess member, said overlap preventing displaced deformable material seams when said protrusion portions are inserted into said recesses of said recess member when said protrusion portion end walls engage said recess member end walls, said protrusion portion for each side having configurations and dimensions that promote congruent insertions into cooperating recess in said recess member; whereby, said ridge formed protrusion portions of said protrusion member and said end walls of said recess member ridges are exposed to a user, thereby providing a visual aid for the user to align and engage ridges extending from said protrusion member to said recess member when said recess and protrusion member ridges secured to bottom walls of said members are unseen during alignment of said members for insertion of said ridges into the deformable material, thereby forming continuous ridges extending from said recess member to said protrusion member, said ridges ultimately forming corresponding seamless designs in the predetermined portion of the deformable material when said bottom walls of said recess and protrusion members engage the predetermined portion of the deformable material.

19. A stamp device having adjacently disposed members with overlapping portions for impressing a seamless pattern in deformable materials comprising:

a plurality of recess members each having a bottom wall with ridges that form a design that is ultimately pressed in a deformable material, and each recess member having a plurality of sides with at least one recess disposed at a peripheral edge of each side of each recess member, each of said plurality of sides of said recess members having a tapered edge portion, said ridges continuously extending upon said bottom wall wherein said ridges ultimately form an end wall aligned with a lateral inner end portion of each recess disposed at a peripheral edge of each side of each recess member, said ridges of said bottom wall of each recess member being disposed upon predetermined surface portions of a deformable material wherein said end walls of said ridges are adjacent to the predetermined surface portions of the deformable material, said ridges ultimately forming corresponding designs in the predetermined surface portions of the deformable material when said bottom wall of said recess members engage the predetermined surface portions of the deformable material; and a plurality of protrusion members each having a bottom wall with ridges that form a design that is ultimately pressed into the deformable material, and each protrusion member having a plurality of sides with at least one protrusion portion formed via ridges extending past a peripheral edge of each side of said plurality of protrusion members, said formed protrusion portions including an end wall that ultimately engages said recess member end walls, each of said plurality of sides of said plurality of protrusion members having a tapered edge portion dimensioned and configured to cooperate with said tapered edge portions of each of said plurality of recess members, said protrusion portions having longitudinal dimensions shorter than longitudinal dimensions of corresponding recesses in said recess members, thereby enabling a tapered edge portion of said protrusion member to vertically engage and overlap a tapered edge portion of said recess member, said overlap preventing displaced deformable material seams when said protrusion portions are inserted into said recesses of said recess member when said protrusion portion end walls engage said recess member end walls, said protrusion portions having configurations and dimensions that promote congruent insertions into corresponding recesses in said recess member, whereby, said ridge formed protrusion portions of said protrusion member and said end walls of said recess member ridges are exposed to a user, thereby providing a visual aid for the user to align and engage ridges extending from said protrusion member to said recess member when said recess and protrusion member ridges secured to bottom walls of said members are unseen during alignment of said members for insertion of said ridges into the deformable material, thereby forming continuous ridges extending from said recess members to said protrusion members, said ridges ultimately forming corresponding seamless designs in the predetermined surface portions of the deformable material when said bottom walls of said recess and protrusion members engage the predetermined surface portions of the deformable material.

* * * * *